United States Patent [19]

Rollmann

[11] Patent Number: 4,536,282

[45] Date of Patent: Aug. 20, 1985

[54] UPGRADING HEAVY CRUDE OILS TO LIGHTER PRODUCTS WITH A DISPERSED ZEOLITE

[75] Inventor: Louis D. Rollmann, Princeton, N.J.

[73] Assignee: Mobil Oil Corporation, New York, N.Y.

[21] Appl. No.: 616,883

[22] Filed: Jun. 4, 1984

Related U.S. Application Data

[63] Continuation of Ser. No. 509,829, Jun. 30, 1983, abandoned, which is a continuation-in-part of Ser. No. 378,143, May 14, 1982, abandoned.

[51] Int. Cl.[3] ..... C10G 11/05

[52] U.S. Cl. ..... 208/120; 208/152; 208/154

[58] Field of Search ..... 208/120, 152, 154

[56] References Cited

U.S. PATENT DOCUMENTS

| | | | |
|---|---|---|---|
| 2,303,083 | 11/1942 | Kuhl | 208/154 |
| 4,054,510 | 10/1977 | Parker | 208/120 |
| 4,119,530 | 10/1978 | Czajkowski et al. | 208/152 |
| 4,251,348 | 2/1981 | O'Rear et al. | 208/120 |
| 4,263,126 | 4/1981 | Rollmann | 208/120 |
| 4,416,766 | 11/1983 | Mulaskey | 208/120 |
| 4,446,007 | 5/1984 | Smith | 208/154 |

*Primary Examiner*—D. E. Gantz
*Assistant Examiner*—Lance Johnson
*Attorney, Agent, or Firm*—Alexander J. McKillop; Michael G. Gilman; Dennis P. Santini

[57] ABSTRACT

This invention provides a process for upgrading a variety of hydrocarbon oils including low-grade crudes and fractions thereof. In this process, a hydrocarbon oil having an ASTM 50% temperature not higher than 550° F. is converted at low temperature and pressure to more volatile products by a dispersion of crystalline zeolite catalysts having a silica: alumina ratio of at least 12 and a C.I. within 1–12. Initially, 0.02–10 wt % of the catalyst is dispersed in the feed until the catalyst inventory in the reactor stage accumulates. Thereafter, catalyst is added and removed to maintain a total catalyst content not greater than about 35 wt % of the feed in the reactor.

5 Claims, 2 Drawing Figures

UPGRADING HEAVY CRUDE OILS TO LIGHTER PRODUCTS WITH A DISPERSED ZEOLITE

This application is a continuation in part of copending application Ser. No. 509,829 filed June 30, 1983, which in turn is a continuation-in-part of application Ser. No. 378,143 filed May 14, 1982, now abandonded.

FIELD OF THE INVENTION

This invention is concerned with a catalytic process for upgrading a heavy oil. It is particularly concerned with crude oils that have a substantial wax content such as, for example, Taching Crude, and fractions thereof. The process of this invention is a catalytic process in which a relatively new type of synthetic zeolite, exemlified by ZSM-5, is employed as catalyst.

BACKGROUND OF THE INVENTION

Fuels refineries historically have shown considerable interest in converting crude petroleum to portable liquid fuels boiling below about 800° F. Particular attention has been paid to processes which are capable of reducing the molecular weight of the heavier distillate fractions to high quality gasoline and middle distillates. Although initially a certain amount of so called thermal cracking was practised, this was supplanted almost entirely by highly effective catalytic processes that produced higher quality gasoline. At the present time practically all petroleum refiners who employ catalytic cracking depend on one version or another of a system in which the cracking catalyst is fluidized by the hyrocarbon feed and is converted while in that state. We shall for convenience collectively refer to these versions as the "fluid catalytic cracking process", or simply "the FCC process".

The outstanding feature of a modern FCC operation is that it is capable of extensively converting a clean distillate feed with minimum formation of unwanted by-products. The process is designed so that the coke by-product is carried with the catalyst and is burned in a regenator to supply necessary process heat. Economy of scale is achieved by building very large plants, typically capable of processing from about 50,000 to about 250,000 barrels per day of feed. The process, however, is not without shortcomings.

In order to restrict formation of by-products in the FCC process, it is necessary that the feed to the cracker be very low in metal content. Thus, it is current practice in almost all refineries to feed either a distillate, such as a gas oil, as the only material charged to the cracker, or predominantly a distillate together with a relatively minor quantity of other less desirable oil. This restriction on the nature of the feed is not a serious one so long as the refiner has available to him an abundant supply of a high quality crude, such as Arab Light, for instance. However, as is well known to those skilled in the art, such feeds with their large content of gas oil are becoming markedly less available, in part due to exhaustion of the supply and in part because of various other reasons. For instance, some of the significant newer finds, such as Alaska, make available crudes which are of lower quality than Arab Light. It is known that Alaskan Crude contains a relatively small fraction of gas oil and a relatively large residual oil content, making it not particularly a suitable feed for a refinery that is designed to process the better quality feeds. A second disadvantage of the FCC process is that plants must be very large in order to achieve economy of scale. As a consequence, any downtime required for maintenance or for other reason represents a significant disruption in the overall operation of the refinery, including management of the crude supply. Thus, a need has developed for processes to efficiently upgrade lower quality crudes in order to insure adequate supplies of portable liquid fuels as the availability of premium crudes declines. Most desirable would be now processes which operate at modest temperatures and low pressures, and which need not be installed on a grand scale to be economically viable.

U.S. Pat. No. 4,263,126 to Rollmann provides a method for converting waxy hydrocarbon oils to lower pour point, less viscous oils. By this method, a reactive dispersion of a zeolite such as HZSM-5 crystals is prepared with the oil to be converted, and conversion is effected by heating the dispersion. This patent is incorporated herein by reference as if fully set forth.

U.S. Pat. No. 4,282,085 to O'Rear et al. discloses extending the ZSM-5 catalyst life by dewaxing hydrodenitrogenated oils.

It is an object of this invention to provide a catalytic process for upgrading without prior hydrodenitrogenation a heavy waxy hydrocarbon oil that contains a residual oil fraction boiling above about 800° F. It is a further object of this invention to provide a catalytic conversion process wherein catalyst is conserved by regeneration and recycling, and wherein a heavy hydrocarbon oil is converted in part to gasoline and distillate. It is a further object of this invention to provide a catalytic conversion process with catalyst recycle and which utilizes a small inventory of catalyst. It is a further object of this invention to provide a low-pressure catalytic process wherein a mixture of virgin and regenerated catalyst is used to upgrade a residual oil fraction. These as well as other objects will become evident to one skilled in the art on reading this entire specification including the claims appended hereto.

SUMMARY OF THE INVENTION

In the process of this invention, a heavy waxy hydrocarbon oil that may contain a residual fraction is contacted with a particulate catalyst comprising a crystalline zeolite having a silica to alumina ratio of at least 12 and a Constraint Index of 1 to 12. It is characteristic of the catalyst that some of the particles are catalytically older than others. Contacting is effected by separably dispersing up to about 35 wt% of catalyst particles in said oil as more fully described below, and maintaining the dispersion in a reaction zone under conversion conditions including a temperature of 550° to 1050° F., preferably 550° to 850° F., a pressure of 0 to 75 psig, and for a time adequate to convert at least 10 wt% of the heavy oil. Under these conditions most of the converted oil is cracked or hydrocracked selectively to gasoline and naphtha, the remainder of the heavy oil usually becoming progressively more refractory as conversion progresses. The cracked oil is removed from the reaction zone, preferably concurrently with its formation, and the remaining dispersion of deactivated catalyst, which usually is only partially deactivated, is passed to a separation zone to recover the refractory oil. Generally, the recovered refractory oil will have a lower pour point than the feed, and thus it is upgraded. The deactivated catalyst is recycled in one of several ways, as more fully described hereinbelow. In all embodiments of this invention it is contemplated to add at least a small amount of virgin catalyst to the circulating inventory to compensate either for loss of activity or for loss of selectivity.

In one embodiment of this invention, a portion of the circulating catalyst is removed via a side stream and discarded, and is replaced by virgin catalyst as more fully described hereinbelow. In another embodiment it is contemplated only to add virgin catalyst. In still another embodiment, the deactivated catalyst is regenerated before recycling. Which embodiment is most advantageous will depend on the nature of the heavy oil feed, as more fully described below.

In general, it is preferred to conduct the contacting step in the absence of added hydrogen. However, hydrogen may be used.

DETAILED DESCRIPTION OF THE INVENTION

Figure 1:
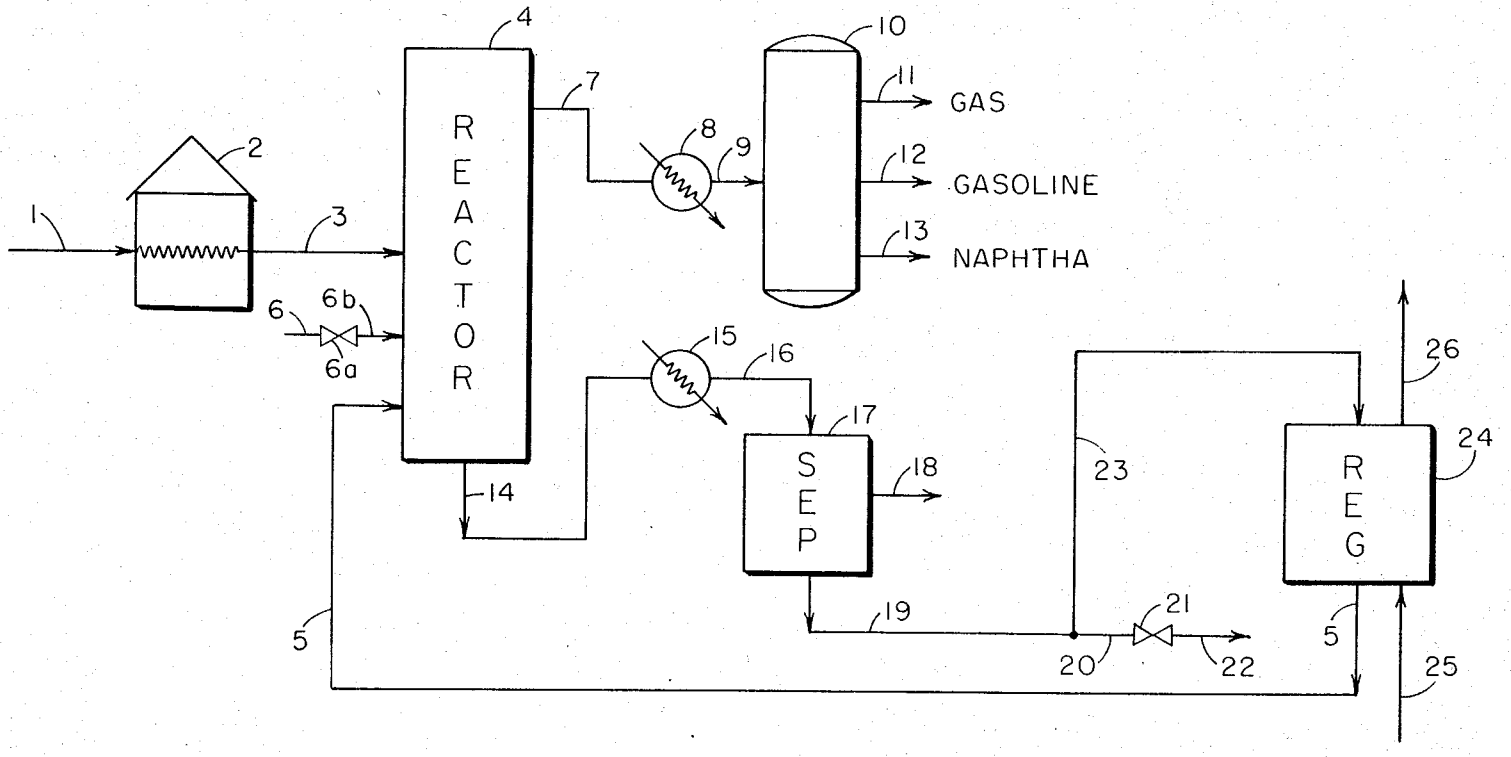
FIG. 1 of the drawing is a flow sheet illustrating the invention.

A wide range of hydrocarbon oil feeds may be used in the process of this invention. For example, the process may be adapted to upgrading a high pour point distillate such as that described in U.S. Pat. No. 4,067,797 issued to Chen et al Jan. 10, 1978. In that patent is described the dewaxing by a fixed bed process of an Arabian Light gas oil boiling in the range of 470° to 730° F. Note that the term "heavy" as used in the present disclosure and claims means a feed which contains at least 50 wt% of a fraction boiling above about 550° F. at atmospheric pressure, or, alternatively, an oil that has an ASTM 50% temperature not lower than about 550° F. Examples 19 to 30 of the cited Chen et al patent describes the dewaxing of the 645° to 750° F. portion of the wider cut Arabian Light gas oil, and this fraction clearly illustrates a heavy, waxy hydrocarbon oil feed within the scope of the present invention. For purposes of the present invention, a hydrocarbon oil that has an ASTM 50% temperature lower than about 550° F. often may be fractionated to provide a suitable heavy hydrocarbon feed. The entire content of U.S. Pat. No. 4,067,797 is incorporated herein by reference.

The heavy Arabian Light gas oil illustrated above, being a distillate, represents a very high quality feed substantially free of metals. Such a feed utilized in the present invention will be characterized by demanding a relatively small circulating inventory of catalyst and low catalyst consumption, as will be more fully described hereinbelow.

Other feeds that may be used in the process of this invention include waxy whole crudes, topped crudes, vacuum gas oils, and, in general, any hydrocarbon oil derived from petroleum, coal, shale, or from another source, providing that the oil has an ASTM 50% temperature not lower than about 550° F. U.S. Pat. No. 4,263,126 to Rollmann cited above discloses the properties, including the composition, and the conversion of virgin Taching whole crude. It is noted therein in Example 1 that 60.5% of the crude is a residual oil fraction boiling above 800° F., and therefore a heavy oil within the scope of this invention. Thus, the hydrocarbon oil feed utilized on the process of this invention may contain a residual fraction. The Taching crude, unlike the Arabian Light distillate contains metals. Therefore, when this type of feed is used, the circulating inventory of catalyst will be relatively large, and to control catalyst consumption, it will be required to regenerate all or part of the circulating inventory of catalyst, as more fully described herein below.

The term "waxy" as used herein means any oil that has a substantial content, such as more than about 10 wt % of paraffin-like hydrocarbons boiling above about 550° F. and that is convertible by the process of this invention to lower molecular weight liquid hydrocarbons. Wax base and mixed base crudes or fractions thereof are suitable sources for feed. Feeds derived from Arabian Light, Taching and Minas crude are illustrative, as are high pour point hydrocracked lube stocks. Although many crudes and other oils provide convertible feedstocks for the process of this invention, there are some crudes that provide very refractory fractions, presumably because of insufficient content of paraffin-like hydrocarbons.

This invention will now be described by reference to the drawing.

FIG. 1 of the drawing is a flow sheet that illustrates one embodiment of the present invention. The oil feed is passed via line (1) to a furnace (2) where it is heated to reaction temperature. The heated feed passes via line (3) to the reactor section (4). The reactor section (4) is provided with means, such as stirrer means, for dispersing a total of 0.1 to 35 parts by weight of catalyst in said heated oil feed. The catalyst is provided to the reactor section as recycled partially deactivated catalyst via line (5). Also, from time to time, or continuously if needed, makeup is introduced via line (6) whereby forming a dispersion of catalyst having the characteristic that some of the particles are catalytically older than others. The dispersion is retained in the reactor section at a temperature of 550° to 850° F. and at a pressure of 0 to 75 psig for a period of time effective to convert at least about 10 wt% of said heavy feed to more volatile liquid hydrocarbons. The more volatile liquid hydrocarbon conversion products are removed as vapor via line (7), the removal proceeding preferably concurrently with formation. The hot vapors are passed from line (7) through cooling means (8) and then via line (9) to tower (10). In tower (10), the converted products are separated into gas, which is removed via line (11); gasoline, which is removed via line (12); and distillate, which is removed via line (13). The unconverted feed containing separably dispersed catalyst is withdrawn from the reactor section via line (14), and passed through cooler (15) after which it is introduced into the separation section via line (16). The separation section is provided with one or more separation means such as cyclones, centrifugal means, or continuous filter means, whereby the partially deactivated catalyst and the refractory oil are separated. The refractory oil is withdrawn from the separation section via line (18). The partially deactivated catalyst is withdrawn from the separation section via line (19) and the major fraction or all of it is passed via line (23) to the regenerator (24). The regenerator section (24) is provided with regeneration means, which in most instances includes means for regenerating the catalyst by burning in air at temperatures of about 1100° F. or higher. When the catalyst is burned with air to remove coke deposits, air is introduced via line (25) and flue gas is discharged via line (26). The regenerated catalyst is removed from the regenerator section (24) via line (5) and is returned to the reactor section (4). From time to time, or continuously if needed, a portion of the partially deactivated catalyst withdrawn via line (19) is passed via line (20) and control valve (21) and is discarded via line (22).

Various modifications of the above described process are contemplated. The process may be operated semi-continuously or continuously, for example. In a semi-continuous operation, two or more reactors may be arranged in parallel and operated as batch reactors, but discharged sequentially via line (14) thereby providing continuous operation of the downstream facilities. Also, when the process is conducted with a very clean feed under conditions such that little coke is formed, most of the partially deactivated catalyst in line (23) may be diverted to the return line (5), by-passing the regererator (24). In one mode of operation contemplated for a clean distillate feed, for example, the reactor may be started up with a very small amount of catalyst, such as from about 0.02 up to about 10 parts by weight of a virgin particulate catalyst dispersed in 100 parts by weight of feed, the regenerator (24) by-passed, and deterioration of catalyst activity compensated by adding virgin catalyst until such a time as the concentration of the catalyst in the dispersion exceed 35 wt%, for example. The catalyst at this point is discharged via line (22) and discarded or regenerated batchwise. Other modifications than those indicated will occur to those skilled in the catalytic art.

Figure 2:
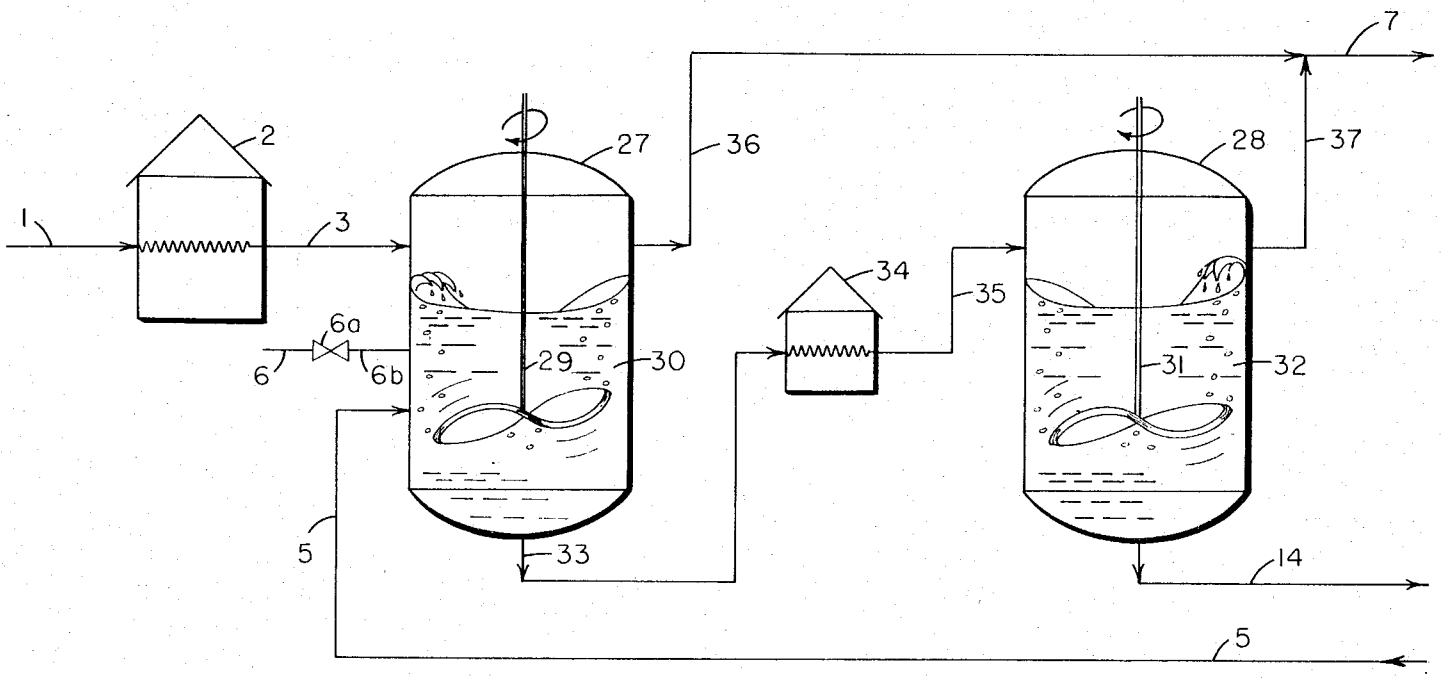
FIG. 2 of the drawing illustrates one configuration for the reactor section.

FIG. 2 of the drawing illustrates one configuration for the reactor section. The convertible heavy oil feed is passed via line (1) to furnace (2) where it is brought to reaction temperature. The heated oil feed passes via line (3) into stirred tank reactor (27) which is provided with a stirrer (29). Regenerated catalyst is introduced into vessel (27) via line (5), and from time to time, or continuously as the case may be, virgin catalyst is passed via line (6), control valve (6A), and line (6B) into the stirred tank. Separable reactive dispersion is formed in tank (27), and the lower molecular weight reaction products are withdrawn from the tank via line (36). The remaining dispersion of catalyst in oil (30) is passed via line (33) to reheat means (34) where the temperature is raised and the reheated oil is passed via line (35) to stirred tank reactor (28) provided with stirrer (31). Further conversion takes place in stirred tank (28) with the removal of more volatile liquid products via line (37). The remaining liquid phase (32) which consists of refractory oil containing therein separably dispersed partially deactivated catalyst is withdrawn via line (14) and passed to downstream facilities as shown in FIG. 1. The more volatile liquid hydrocarbons in line (36) and in line (37) are combined in common conduit (7) and passed to separation means as shown in FIG. 1. Note that elements common to FIG. 1 and FIG. 2 bear the same indicia.

The stirrer means illustrated in FIG. 2 may be replaced by other means for maintaining the catalyst in a dispersed state. For instance, part of the gaseous product recovered from line (11) may be recycled to the stirred tanks to maintain reasonably uniform suspension of the catalyst. Alternatively, if hydrogen is used, the catalyst may be maintained in suspension by the hydrogen gas.

The configuration for the reactor section (4) depicted in FIG. 2 is only one of several possible configurations. Others will readily occur to one skilled in the catalytic art.

The present invention depends on utilizing a particular crystalline zeolite as an active component of the catalyst, and on employing the catalyst per se in the particular manner set forth herein. More specifically, in the process of the present invention it is contemplated to recycle at least 50 wt% of the catalyst thereby making use of residual activity and deriving other benefits from these catalytically older particles, and at the same time to derive full benefit from the phenomenal activity that is disclosed in U.S. Pat. No. 4,263,126 for virgin (catalytically young) catalyst. Since recycling reduces catalyst cost, the refiner gains flexibility in that he may use *more* catalyst to reduce contact time, and therefore process the same amount of feed efficiently with a small size plant. The older catalyst particles, in addition to contributing to catalyst activity, provide an extended surface for sorption of impurities such as metals and nitrogen compounds, thereby conserving the high activity of the catalytically young particles.

The crystalline zeolites useful herein are members of a novel class of zeolites that exhibit unusual properties. Although these zeolite have unusually low alumina contents, i.e. high silica to alumina ratios, they are very active even when the silica to alumina ratio exceeds 30. The activity is surprising since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning with oxygen-containing gas such as air.

An important characteristic of the crystal structure of this class of zeolites is that it provides constrained access to and egress from the intracrystalline free space by virtue of having an effective pore size intermediate between the small pore Linde A and the large pore Linde X, i.e. the pore windows of the structure have about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mol ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful in this invention have an effective pore size such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although in some instances excessive puckering of the rings or pore blockage may render these zeolites ineffective. 12-membered rings usually do not offer sufficient constraint to produce the advantageous conversions, although the puckered 12-ring structure of TMA offretite shows constrained access. Other 12-ring structures may exist which, due to pore blockage or to other cause, may be operative.

Rather than attempt to judge from crystal structure whether or not a zeolite possesses the necessary constrained access to molecules larger than normal paraffins, a simple determination of the "Constraint Index" as herein defined may be made by passing continuously a mixture of an equal weight of normal hexane and 3-methylpentane over a small sample, approximately one gram or less, of zeolite at atmospheric pressure and determining the fraction remaining unchanged for each of the two hydrocarbons, from which the Constraint Index is calculated as follows:

$$\text{Constraint index} = \frac{\log_{10}(\text{fraction of n-hexane remaining})}{\log_{10}(\text{fraction of 3-methylpentane remaining})}$$

A detailed description of the procedure for determining the Constraint Index appears in an article titled "Catalysis by Crystalline Aluminosilicates: Characterization of Intermediate Pore-Size Zeolites by the Constraint Index" which appears in Journal of Catalysis, vol. 67, page 218 (1981), the entire content of which is incorporated herein by reference as if fully set forth.

The class of zeolites defined herein is exemplified by ZSM-5, ZSM-11, ZSM-12, ZSM-23, ZSM-35, ZSM-38, and other similar materials.

U.S. Pat. No. 3,702,886 describing and claiming ZSM-5 is incorporated herein by reference.

ZSM-11 is more particularly described in U.S. Pat. No. 3,709,979, the entire content of which is incorporated herein by reference.

ZSM-12 is more particularly described in U.S. Pat. No. 3,832,449, the entire content of which is incorporated herein by reference.

ZSM-23 is more particularly described in U.S. Pat. No. 4,076,842, the entire content of which is incorporated herein by reference.

ZSM-35 is more particularly described in U.S. Pat. No. 4,016,245, the entire content of which is incorporated herein by reference.

ZSM-38 is more particularly described in U.S. Pat. No. 4,046,859, the entire content of which is incorporated herein by reference.

ZSM-5 and ZSM-11 are the preferred zeolites for purposes of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F. for one hour, for example, followed commonly by base exchange with ammonium salts followed by calcination at 1000° F. in air. More generally, it is desirable to activate this type catalyst by base exchange with ammonium salts followed by calcination in air at about 1000° F. for from about 15 to about 24 hours.

For purposes of this invention, the zeolite selected preferably is one that has a crystal framework density, in the dry hydrogen form, of not less than about 1.6 grams per cubic diameter. It has been found that zeolites which satisfy all three criteria, a Constraint Index as defined above of about 1 to about 12, a silica to alumina ratio of at least about 12 and a dried crystal density of not less than about 1.6 grams per cubic centimeter, are most effective. The dry density for known structures may be calculated from the number of silicon plus aluminum atoms per 1000 cubic Angstroms, as given, e.g., on Page 19 of the article of Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pyknometer techniques. For example, it may be determined by immersing the dry nitrogen form of the zeolite in an organic solvent which is not sorbed by the crystal. Or, the crystal density may be determined by mercury porosimetry, since mercury will fill the interstices between crystals but will not penetrate the intracrystalline free space. It is possible that the unusual sustained activity and stability of this class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4, Omega | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

A platinum group metal may be incorporated with the zeolite by any method known in the art, including base exchange and impregnation. The zeolite preferably is incorporated in a matrix to form the final catalyst. Matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays.

In addition to the foregoing materials, the zeolites employed herein may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix on an anhydrous basis may vary widely with the zeolite content ranging from between about 10 to about 99 percent by weight and more usually in the range of about 25 to about 80 percent by weight of the dry composite. For purposes of the present invention, the preferred material is alumina.

Because the synthetic zeolite crystals as formed usually are not larger than about 10 microns, and in many cases they are much smaller, dispersions of the crystals in oil become difficult or impractical to separate. Such dispersions are not contemplated to be useful in the present invention. Useful, separable dispersions of aggregates of the crystals may be made, however, by including the crystals in a matrix, as outlined above, or by other means such as pelletizing. In general, it is contemplated that the catalyst used herein has an average particle size of at least about 50 microns, preferably with not more than about 5 wt% of the catalyst having particles smaller than 10 microns. For reasons which are self-evident in view of the foregoing description, the dispersing means used should not be sufficiently vigorous as to induce extensive attrition of the catalyst particles lest a dispersion be formed which is non-separable. In any case, some attrition is to be expected with continuous recycling of particles. This attrition is permissable provided it allows practical recovery for recycle of at least about 50% of the catalyst that enters the separation section.

The conversion conditions contemplated for the process of this invention include a temperature of 550° to about 850° F. In general, however, it is preferred not to exceed for any feed the temperature at which the feed normally forms coke when heated in the absence of catalyst.

From the foregoing description, it is evident that this invention provides a unique and adaptable process by which a wide variety of hydrocarbon feedstocks, including low-grade crudes and fractions thereof, may be upgraded with the production of needed liquid fuels in the gasoline and distillate boiling range.

What is claimed is:

1. A process for catalytically upgrading a heavy waxy hydrocarbon oil feed without prior hydrodenitrogenation of said feed, which process comprises the following steps:

(a) separably dispersing in 100 parts by weight of said feed from about 0.02 up to about 10 parts by weight of a virgin particulate catalyst comprising crystalline zeolite having a silica to alumina ratio of at least 12 and a Constraint Index of 1 to 12;

(b) maintaining said dispersion in a reaction zone at a temperature of 550° F. to 1050° F. and a pressure of 0 to 75 psig for a time effective to convert at least about 10 wt% of said heavy feed to more volatile liquid hydrocarbons and removing said more volatile hydrocarbons from said reaction zone whereby forming a residue comprising partially deactivated catalyst separably dispersed in refractory oil;

(c) separating said partially deactivated catalyst from said refractory oil;

(d) repeating steps (a), (b) and (c) including adding in step (a) all of said separated catalyst from previous step (c) until said dispersion in said reaction zone contains about 35 parts by weight of partially deactivated catalyst; and then (e) removing from said process sufficient separated catalyst to maintain a preselected activity or selectivity and a total catalyst content not exceeding about 35 parts per weight per hundred parts by weight of said feed in said reaction zone.

2. The process described in claim 1 wherein said crystalline zeolite is selected from the group consisting of ZSM-5, ZSM-11, ZSM-12, ZSM-23, ZSM-35, ZSM-38 and ZSM-48.

3. The process described in claim 2 wherein said crystalline zeolite is ZSM-5.

4. The process described in claim 2 wherein the amount of virgin particulate catalyst added in each said repetition of step (a) is less than the amount added in the first instance.

5. The process described in claim 2 wherein the amount of virgin particulate catalyst added in each repetition of step (a) is less than the amount added in the prior step (a).

* * * * *

UNITED STATES PATENT AND TRADEMARK OFFICE

CERTIFICATE OF CORRECTION

PATENT NO. : 4,536,282

DATED : August 20, 1985

INVENTOR(S) : Louis D. Kollmann

It is certified that error appears in the above-identified patent and that said Letters Patent is hereby corrected as shown below:

Column 2, line 9, "now" should be -- new --.

Signed and Sealed this

Sixth Day of January, 1987

*Attest:*

DONALD J. QUIGG

*Attesting Officer*

*Commissioner of Patents and Trademarks*